US011499547B2

(12) United States Patent
Zhang et al.

(10) Patent No.: US 11,499,547 B2
(45) Date of Patent: Nov. 15, 2022

(54) HYDRAULIC FRACTURING PUMP HEALTH MONITOR

(71) Applicant: Caterpillar Inc., Peoria, IL (US)

(72) Inventors: Yanchai Zhang, Dunlap, IL (US); Zhijun Cai, Dunlap, IL (US); Nathan S. Pauli, Peoria, IL (US); Zhaoxu Dong, Dunlap, IL (US); Yong Sun, Dunlap, IL (US); Xuefei Hu, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 318 days.

(21) Appl. No.: 16/802,949

(22) Filed: Feb. 27, 2020

(65) Prior Publication Data

US 2021/0270261 A1 Sep. 2, 2021

(51) Int. Cl.

| | |
|---|---|
| ***F04B 51/00*** | (2006.01) |
| ***E21B 43/26*** | (2006.01) |
| ***F04B 53/18*** | (2006.01) |
| ***F04B 47/02*** | (2006.01) |

(52) U.S. Cl.

CPC ..... *F04B 51/00* (2013.01); *E21B 43/26* (2013.01); *F04B 47/02* (2013.01); *F04B 53/18* (2013.01); *F04B 2201/1207* (2013.01); *F04B 2205/11* (2013.01); *F04B 2207/70* (2013.01)

(58) Field of Classification Search

CPC ..... F04B 49/10; F04B 49/065; F04B 51/00; F04B 53/18; F04B 2201/0402; F04B 2201/0404; F04B 2201/0802; G01M 13/028; G01M 3/025; G05B 23/0283

See application file for complete search history.

(56) References Cited

U.S. PATENT DOCUMENTS

| | | | | |
|---|---|---|---|---|
| 9,488,226 | B2 | 11/2016 | Watanabe | |
| 10,436,766 | B1 * | 10/2019 | Bayyouk | F04B 53/18 |
| 2004/0167738 | A1 * | 8/2004 | Miller | F04B 51/00 702/114 |
| 2011/0239856 | A1 * | 10/2011 | Tiller | F04B 53/18 92/153 |

(Continued)

FOREIGN PATENT DOCUMENTS

| | | | |
|---|---|---|---|
| CN | 204511849 | U | 7/2015 |
| CN | 104697787 | B | 3/2019 |
| ER | 1731893 | B1 | 8/2012 |

*Primary Examiner* — Kenneth J Hansen

(74) *Attorney, Agent, or Firm* — von Briesen & Roper, s.c.

(57) ABSTRACT

A hydraulic fracturing machine includes a pump failure detection system. The hydraulic fracturing machine includes a hydraulic fracturing pump with a power end and a fluid end. The power end includes a plurality of roller bearings, and the fluid end includes a flow of fluid. A particle sensor coupled to the power end is configured to transmit particle information regarding a quantity of particles in the fluid. A temperature sensor, also coupled to the power end, is configured to transmit temperature information regarding a temperature of the fluid. A vibration sensor coupled to the power end is configured to transmit vibration information regarding a vibration of each of the plurality of roller bearings. An electronic control module analyzes the particle information, the temperature information and the vibration information, and calculates a failure warning level based on the analysis.

13 Claims, 6 Drawing Sheets

(56) References Cited

U.S. PATENT DOCUMENTS

| | | | | |
|---|---|---|---|---|
| 2016/0177945 | A1* | 6/2016 | Byrne | F04B 53/18<br>184/6 |
| 2017/0091358 | A1 | 3/2017 | Zhang et al. | |
| 2017/0362928 | A1 | 12/2017 | Kang et al. | |
| 2019/0120024 | A1 | 4/2019 | Oehring et al. | |
| 2019/0129408 | A1 | 5/2019 | Celia et al. | |

* cited by examiner

HYDRAULIC FRACTURING PUMP HEALTH MONITOR

TECHNICAL FIELD

The present disclosure generally relates a hydraulic fracturing system and, more specifically, to a system and method for detecting a pump failure of a hydraulic fracturing machine.

BACKGROUND

Hydraulic fracturing or "fracking" is a means for extracting oil and gas from rock, typically to supplement a horizontal drilling operation. In operation, high pressure fracturing fluid, which may include granular materials such as sand and other agents, is used to produce fractures or cracks in rock far below the Earth's surface, stimulating the flow of oil and gas through the rock. The hydraulic fracturing rig or "frac rig" used to inject the fracturing fluid typically includes, among other components, an engine, transmission, driveshaft and hydraulic pump. The pump is used to pressurize and inject the fracturing fluid, and typically includes several components that may be subject to high working pressures.

An overall health and performance of the pump relies on the health of its individual components. As a result of the abrasive and sometimes corrosive nature of the fracturing fluid and the high pressures at which the pump is operated, individual pump components can wear down, causing the pump to malfunction or even fail. The malfunction or failure of the pump can also cause a malfunction and/or a failure of the entire hydraulic fracturing rig.

In order to maintain the life of the pump, and in turn the hydraulic fracturing rig, the health and performance of the pump components should be monitored regularly. In an example health monitoring system disclosed in U.S. Patent Publication No. 2015/0356521, utilizes pressure and temperature sensors to predict future reliability of equipment in the field of oil and gas exploration and production. More specifically, the system uses a controller to determine the current operating conditions of oil field equipment. The current operating conditions are determined from sensors and parameters that are known (or believed) to correlate to proper operation of the unit of equipment. The system collects data for determining condition values through various sensors, such as temperature and pressure sensors.

Such systems, however, collect data infrequently and rely on a single type of sensor, resulting in inaccurate or delayed detection of pump failure. There is consequently a need for a high speed engine control module capable of determining, in real time, accurate, early detection of pump component failure through analysis of data transmitted by multiple types of sensors, including vibration sensors, oil quality or oil debris sensors, temperature sensors, and others.

SUMMARY OF THE DISCLOSURE

In one aspect of the present disclosure, a hydraulic fracturing machine with pump failure detection system is disclosed. The hydraulic fracturing machine includes a hydraulic fracturing pump having a power end and a fluid end, the power end including a plurality of roller bearings, and the fluid end having a flow of fluid. The hydraulic fracturing machine also includes a particle sensor coupled to the power end and configured to transmit particle information regarding a quantity of particles in the fluid, and a temperature sensor coupled to the power end and configured to transmit temperature information regarding a temperature of the fluid. The hydraulic fracturing machine also includes a vibration sensor coupled to the power end and configured to transmit vibration information regarding a vibration of each of the plurality of roller bearings. Finally, the hydraulic fracturing machine also includes an electronic control module configured to analyze the particle information, the temperature information and the vibration information, and to calculate a failure warning level based on the analysis.

In another aspect of the present disclosure, a failure detection system for a hydraulic pump including a lubrication system includes a particle sensor operatively disposed in the lubrication system. The particle sensor is configured to monitor and transmit particle data including a quantity of particles in a lubricant flowing through the lubrication system. The failure detection system also includes an inlet temperature sensor operatively disposed in an inlet valve of the lubrication system, and an outlet temperature sensor operatively disposed in an outlet valve of the lubrication system. Each of the inlet temperature sensor and the outlet temperature sensor is configured to monitor and transmit temperature data including a temperature of the lubricant.

The failure detection system further includes a plurality of vibration sensors coupled to a power end of the hydraulic pump and configured to monitor and transmit vibration data, including an acceleration of each of a plurality of roller bearings. Finally, the failure detection system includes an electronic control module in operative communication with the particle sensor, the temperature sensor, and the plurality of vibration sensors. The electronic control module is coupled to the power end of the hydraulic pump and is configured to receive the particle data transmitted by the particle sensor, determine a quantity of particles in the lubricant based on the received particle data, trigger a quality warning if the quantity of particles exceeds a predetermined threshold particle value, receive the temperature data transmitted by the inlet temperature sensor and the outlet temperature sensor, calculate a difference value between the temperature data received from the inlet temperature sensor and the temperature data received from the outlet temperature sensor, trigger a temperature warning if the difference value exceeds a predetermined threshold temperature value, receive vibration data transmitted by the plurality of vibration sensors, trigger a vibration warning if, after performing vibration based detection calculations on the vibration data, a threshold vibration value is exceeded, calculate a failure warning level of the hydraulic pump based on the quality warning, the temperature warning and the vibration warning, and transmit the failure warning level to an operator of the hydraulic pump.

In yet another aspect of the present disclosure, a method of detecting a failure of a hydraulic pump is disclosed. The method includes monitoring discharge pressure signals of a fluid flowing through the hydraulic pump, monitoring pump speed signals of the hydraulic pump, monitoring temperature signals of the fluid, monitoring fluid quality signals of the fluid, and monitoring vibration signals of a power end of the hydraulic pump. The method further includes analyzing the temperature signals to determine a temperature value, and analyzing the fluid quality signal to determine a fluid quality value. The method includes performing vibration based detection calculations on the vibration signals, the pump speed signals and the discharge pressure signals to determine a vibration value, triggering a temperature warning if the temperature value exceeds a predetermined temperature threshold, and triggering a fluid quality warning if the fluid quality value exceeds a predetermined quality threshold. Finally, the method includes calculating a failure warning level based on the vibration value, the temperature warning and the fluid quality warning, and displaying the failure warning level to an operator of the hydraulic pump.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

The detailed description of exemplary embodiments of the disclosure herein makes reference to the accompanying drawings and figures, which show the exemplary embodiments by way of illustration only. While these exemplary embodiments are described in sufficient detail to enable those skilled in the art to practice the disclosure, it should be understood that other embodiments may be realized and that logical and mechanical changes may be made without departing from the spirit and scope of the disclosure. It will be apparent to a person skilled in the pertinent art that this disclosure can also be employed in a variety of other applications. Thus, the detailed description herein is presented for purposes of illustration only and not of limitation. For example, the steps recited in any of the method or process descriptions may be executed in any order and are not limited to the order presented.

For the sake of brevity, conventional data networking, application development and other functional aspects of the systems (and the user operating components of the systems) may not be described in detail herein. It should be noted that many alternative or additional functional relationships or physical connections may be present in a practical system.

Figure 1:
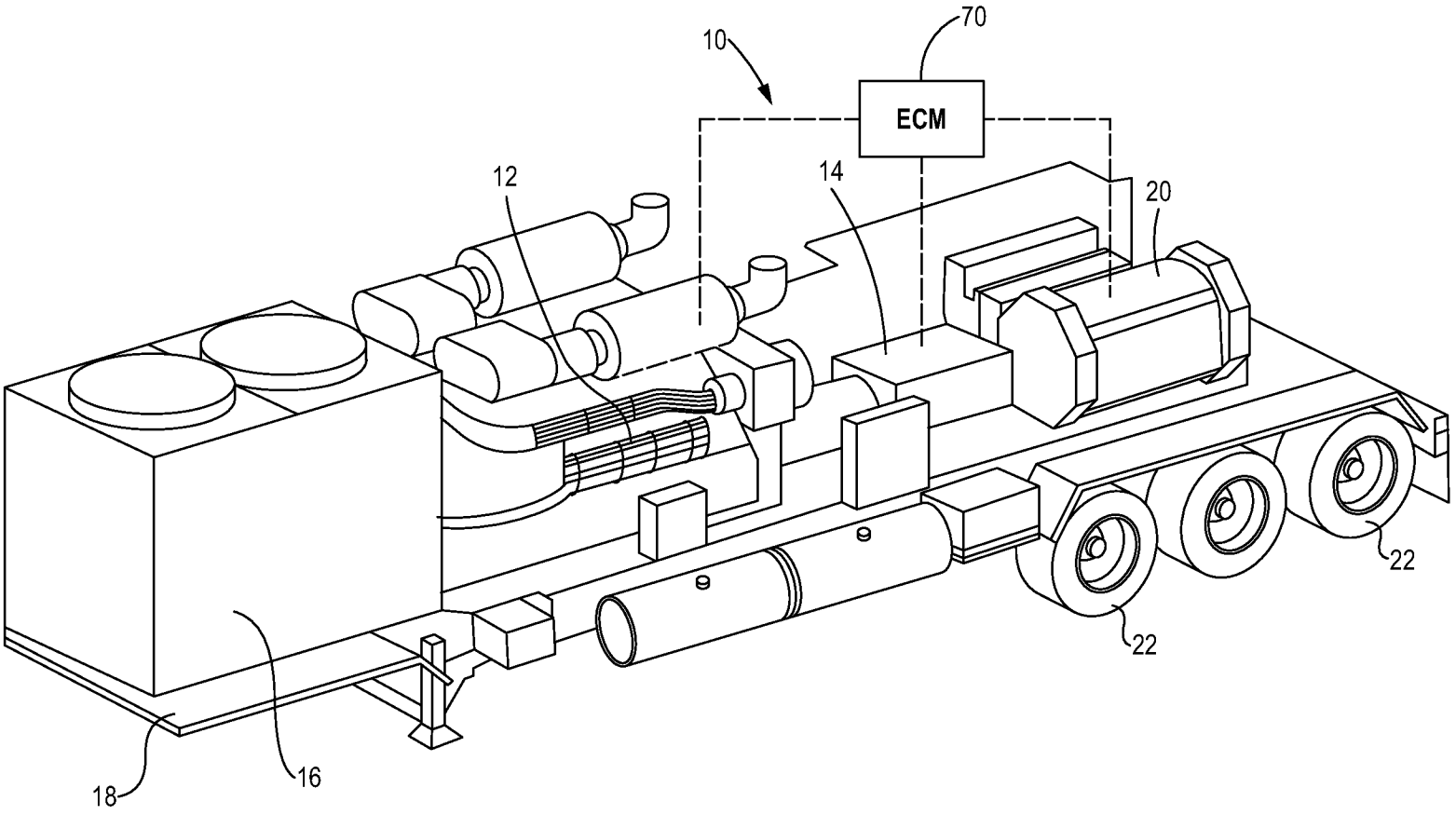
FIG. 1 is a perspective view of a fracturing machine, in accordance with an embodiment of the present disclosure.

FIG. 1 illustrates a perspective view of a fracturing machine 10, according to an embodiment of the present disclosure. The exemplary fracturing machine 10, also called a "fracking machine" or "fracking rig," may be used to pressurize hydraulic fracking fluid. In a fracking operation, for example, one or more fracking machines 10 may be arranged to pump the fracking fluid into subterranean rock formations, causing the formations to fracture. The fracking fluid, which may be prepared onsite, may include water mixed with sand, ceramic particles, or other propellants. These propellants may assist in holding the fractures open after hydraulic pressure is removed. Oil and/or gas retained in the subterranean rock formations is thereby released, and can be recovered at the surface.

The fracking machine 10 may include an internal combustion engine 12, such as a diesel-burning compression ignition engine. However, other types of prime movers may be used, including gasoline-burning spark ignition engines, gas-burning turbines, and the like. The engine 12 may be operatively coupled via drive train components 14 (e.g. a crankshaft, transmission, and driveshaft) to a hydraulic pump 20, which may be used to pump fracking fluid to a wellhead at a high pressure. To cool the internal combustion engine 12, the fracking machine 10 may include a radiator 16 that circulates coolant to and from the engine, thereby transferring any generated heat to the environment. The components of the tracking machine 10 may be disposed on a mobile trailer 18 supported by a plurality of ground engaging mechanisms 22. In the illustrated embodiment, the trailer 18 is equipped with a plurality of wheels, and may be coupled to a truck or other towing vehicle (not shown) that may enable the tracking machine 10 to be moved within a fracking site or to a different location entirely. In other embodiments, however, the tracking machine 10 may remain stationary.

Figure 2:
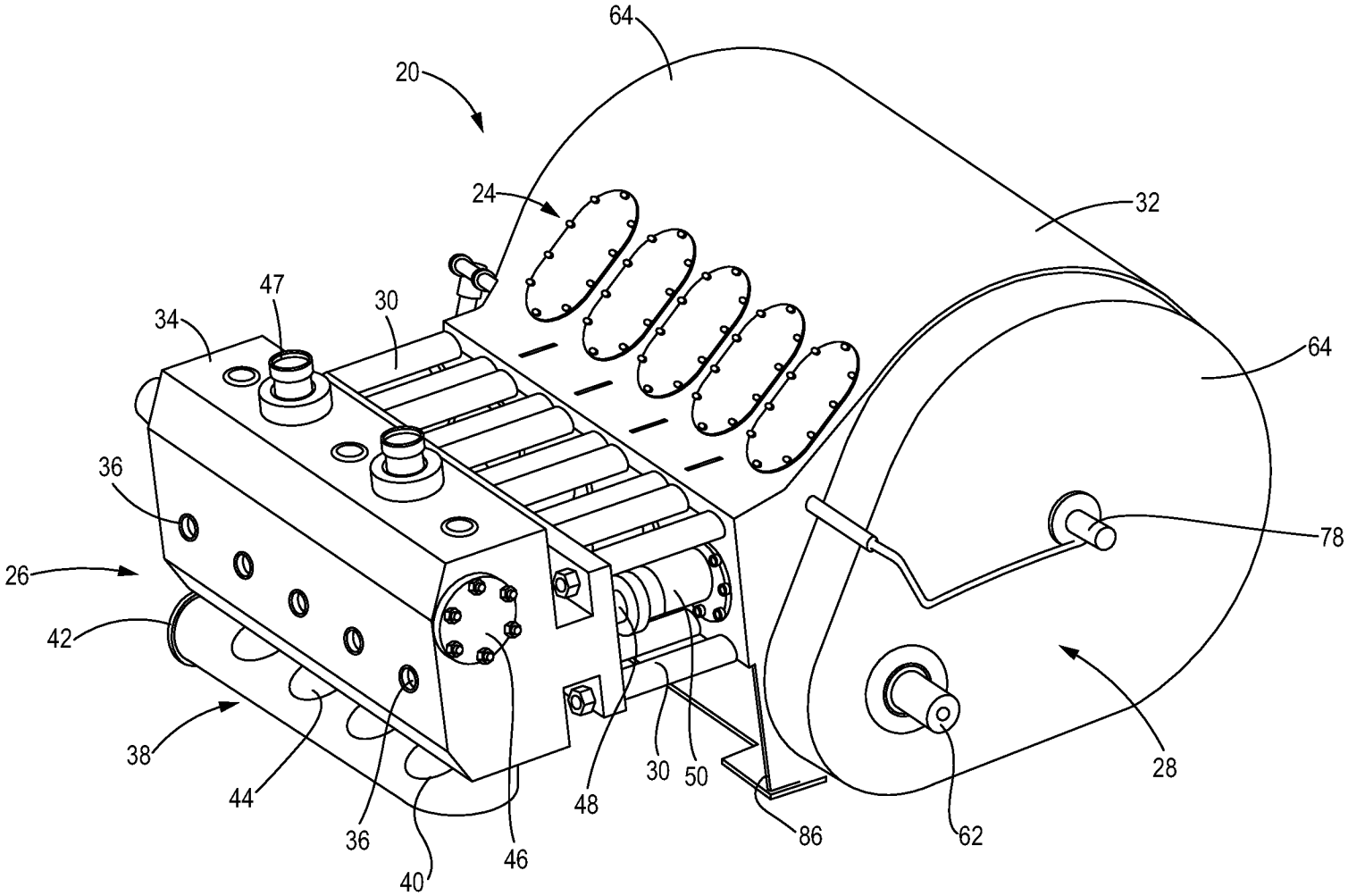
FIG. 2 is a perspective view of a hydraulic pump, in accordance with an embodiment of the present disclosure.

Referring now to FIG. 2, the present pump 20 may include a power end 24 coupled to a fluid end 26 via a plurality of stay rods 30. The stay rods 30 may protrude from a side of a pump housing 32 and can reciprocate back and forth with respect to a pumping unit 34 that pressurizes the low-pressure fracking fluid. The pumping unit 34 is composed of a plurality of pumping chambers 36 arranged in an inline configuration and aligned horizontally with respect to the pump housing 32. In the illustrated embodiment, the pumping unit 34 includes five aligned pumping chambers 36, but in other embodiments may include a fewer or more pumping chambers.

The fluid end 26 may be configured to receive the low-pressure fracking fluid via an inlet manifold 38 disposed generally beneath the pumping unit 34. More specifically, a fluid rail 40 may have an inlet port 42 that may be attached to a hose or other piping and configured to receive the fracking fluid. A plurality of inlet lines 44 lead the tracking fluid to the pumping chambers 36. In response to a forward stroke of a plunger 48 coupled to a pony rod 50 driven by the power end 24 of the hydraulic pump 20, the fracking fluid may then be pumped through one or more discharge outlets 46 disposed on top of the pumping unit. In the illustrated embodiment, the plunger 48 is one of five plungers, with each plunger corresponding to, and interfacing with, one of five pumping chambers. Accordingly, the quantity of plungers may depend on the size of the pump 20 (i.e. three cylinder, five cylinder, etc.). The discharge outlet 46 may connect to high-pressure fluid lines or pipes that direct the pressurized fracking fluid to the wellhead. It should be appreciated that, in other embodiments, different configurations for receiving and discharging fracking fluid to and from the pumping unit 34, including a varying number or position of the discharge outlets 46, are contemplated.

Figure 3:
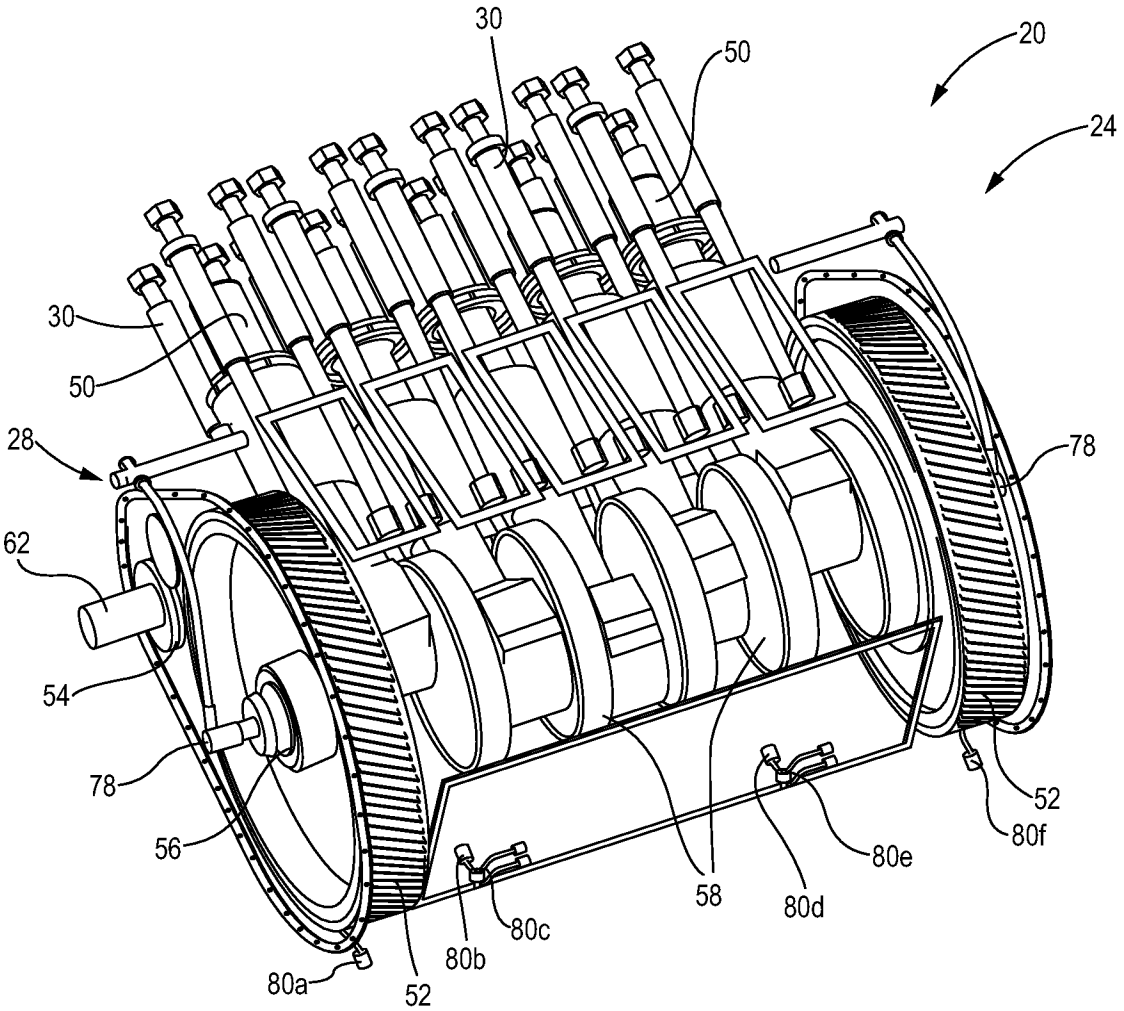
FIG. 3 is a top perspective view of portions of a power end of a hydraulic pump, in accordance with an embodiment of the present invention.

With continued reference to FIG. 2, and further reference to FIG. 3, the reciprocating plunger 48 is driven by the power end 24 of the hydraulic pump 20. The power end 24 includes a crankshaft 56 that is rotated by a gearbox output 52. While FIG. 3 illustrates a gearbox output 52 utilizing a pair of gears, a single gear may also be used. The gearbox output 52 is driven by a gearbox input 54 that is coupled to a transmission (not shown), which drives the gearbox output at a desired rotational speed to achieve the desired pumping power. While not shown, a power source (e.g. a diesel engine) may be connected through the transmission to a drive shaft 62 that rotates the gearbox input 54 during operation. Furthermore, a plurality of roller bearings 58 may be associated with the crankshaft 56. The roller bearings 58 may be cylindrical rollers that facilitate rotational motion of the crankshaft 56.

During operation of the pump 20, friction generated between sliding and rolling surfaces can generate heat or retard movement of various pump components. As such, a power end lubrication system 28 may be used to circulate a lubrication fluid to lubricate and cool certain components of the power end 24. These components may include rolling and sliding surfaces (i.e. sliding bearing surfaces, roller bearing surfaces, and meshed gear tooth surfaces), as well as bearing components themselves. The lubrication fluid used in the lubrication system 28 may be any suitable lubricant, including, for example, oil based lubricants, and may be circulated through the power end 24 of the pump 20. For example, lubrication fluid may be used to lubricate sliding surfaces associated with each pony rod 50, which reciprocate back and forth with respect to the fluid end 26 of the pump 20. As a further example, lubricant fluid may also be circulated through a plurality of crankshaft inlets 78. The lubrication fluid supplied to the crankshaft 56 via the inlets 78 may be delivered at a high pressure, enabling the lubrication fluid to flow between sliding surfaces associated with the crankshaft. The lubrication fluid may also be circulated through a plurality of lubrication conduits (not shown), including, for example, roller bearing conduits, and bypass conduits to provide lubrication fluid to the roller bearings 58. The lubrication conduits may be made of any suitable material, such as rigid pipe or flexible hoses and may include one or more manifolds through which the lubrication fluid flows.

Figure 5:
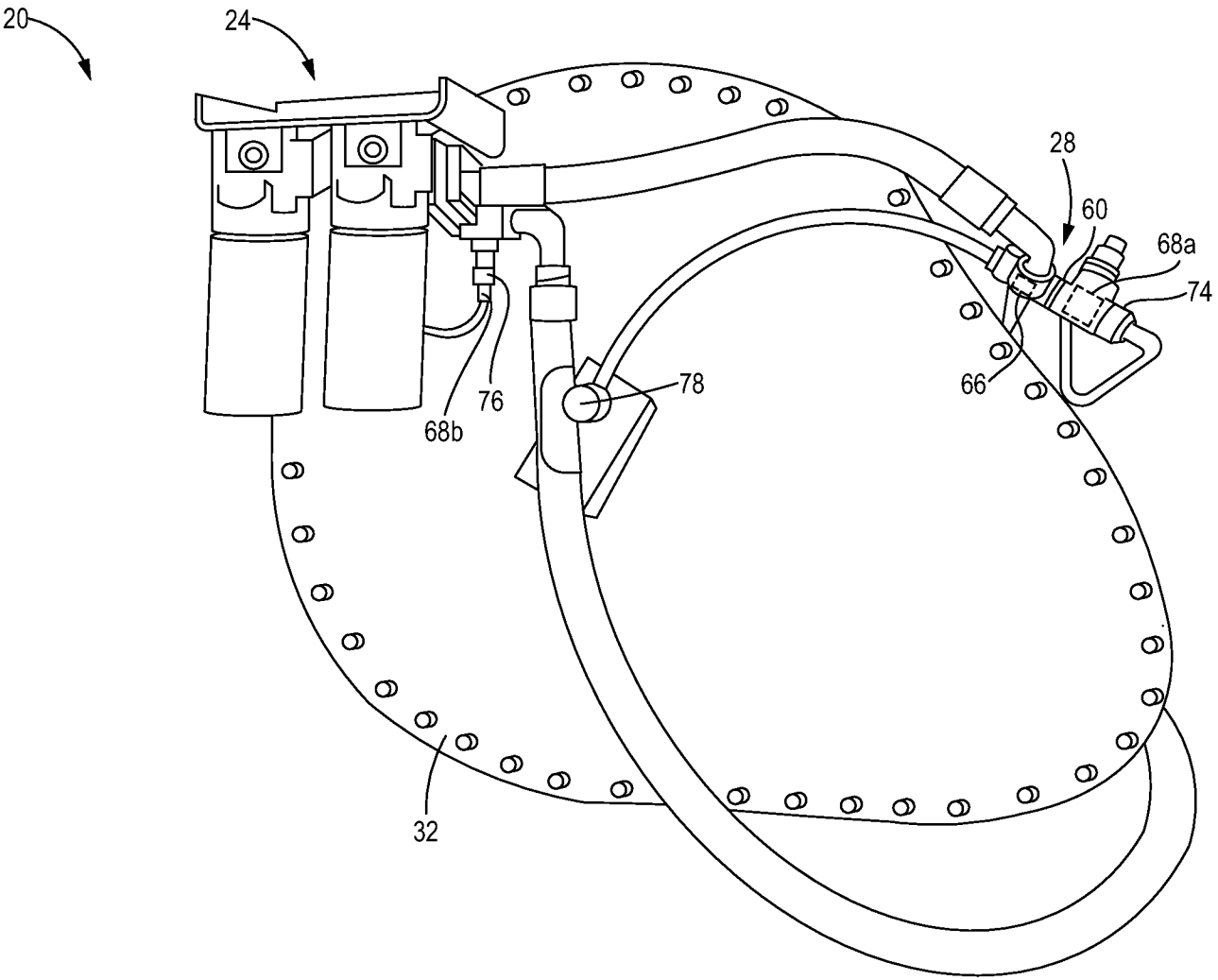
FIG. 5 is a side view of a power end of a hydraulic pump, in accordance with an embodiment of the present disclosure.

Referring briefly to FIG. 5, the lubrication fluid may be pumped into the power end 24 of the hydraulic pump through an inlet valve 74. A lubrication pump (not shown) may be used in conjunction with the inlet valve 74 to direct the lubrication fluid to the various lubrication conduits. Purifying the lubrication fluid may lead to a longer operating life of components of the pump 20. As such, debris or particulates may be removed from the lubrication fluid using a lubricant filter 60 positioned proximate the input valve 74. The lubricant filter 60 may be a ten micron filter, although filters with other pore sizes may be used. The lubrication fluid is discharged from the power end 24 of the pump 20 through a discharge valve 76.

Monitoring the health of the power end 24 of the pump 20 is essential to maintaining optimal performance and preventing premature failure of the pump. Extreme vibrations, caused by unknown defects in the roller bearings 58, shown in FIG. 3, for example, can cause damage to all components of the pump 20. Likewise, circulating lubrication fluid with large particulates or with improper temperature can result in a failure of the lubrication fluid to properly cool and lubricate the sliding and rolling components of the power end 24 of the pump 20. Both examples, if not remedied, can result in catastrophic failure of the pump 20. As such, to monitor the overall health of the power end 24 of the pump 20, a plurality of sensors may be operatively associated with the power end of the pump.

To monitor, regulate, and coordinate operation of various components of the tracking machine 10, including the pump 20, the engine 12, the drive train components 14, and others, as shown in FIG. 1, the fracking machine may be operatively associated with an electronic control module (ECM) or controller 70. The ECM 70 may include any type of device or any type of component that may interpret and/or execute information and/or instructions stored within a memory (not shown) to perform one or more functions. For example, the ECM 70 may use received information and/or execute instructions to determine a level of failure (or health) of the power end 24 of the pump 20 based on a temperature of the lubricant fluid, a quality of the lubricant fluid, and a vibration level of the roller bearings 58 (measured by a plurality of sensors 80*a*-80*f*). The ECM 70 may include a processor (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software. The ECM 70 may transmit, via a network (not shown), information regarding the temperature and quality of the lubricant fluid, as well as the vibration level.

The ECM 70 may be connected to a memory, a display, an input device, a communication interface, and other data structures and devices (not shown). The memory may include a random access memory ("RAM"), a read only memory ("ROM"), and/or another type of dynamic or static storage device e.g., a flash, magnetic, or optical memory) that stores information and/or instructions for use by the example components, including the information and/or instructions used by the ECM 70 (as explained in further detail below). Additionally, or alternatively, the memory may include non-transitory computer-readable medium or memory, such as a disc drive, flash drive, optical memory, read-only memory (ROM), or the like. The memory may store the information and/or the instructions in one or more data structures, such as one or more databases, tables, lists, trees, etc. As will be described in more detail below, the ECM may be configured to receive signals from the plurality of sensors associated with the pump 20 in order to determine a level of failure of the power end 24 of the pump.

Figure 4:
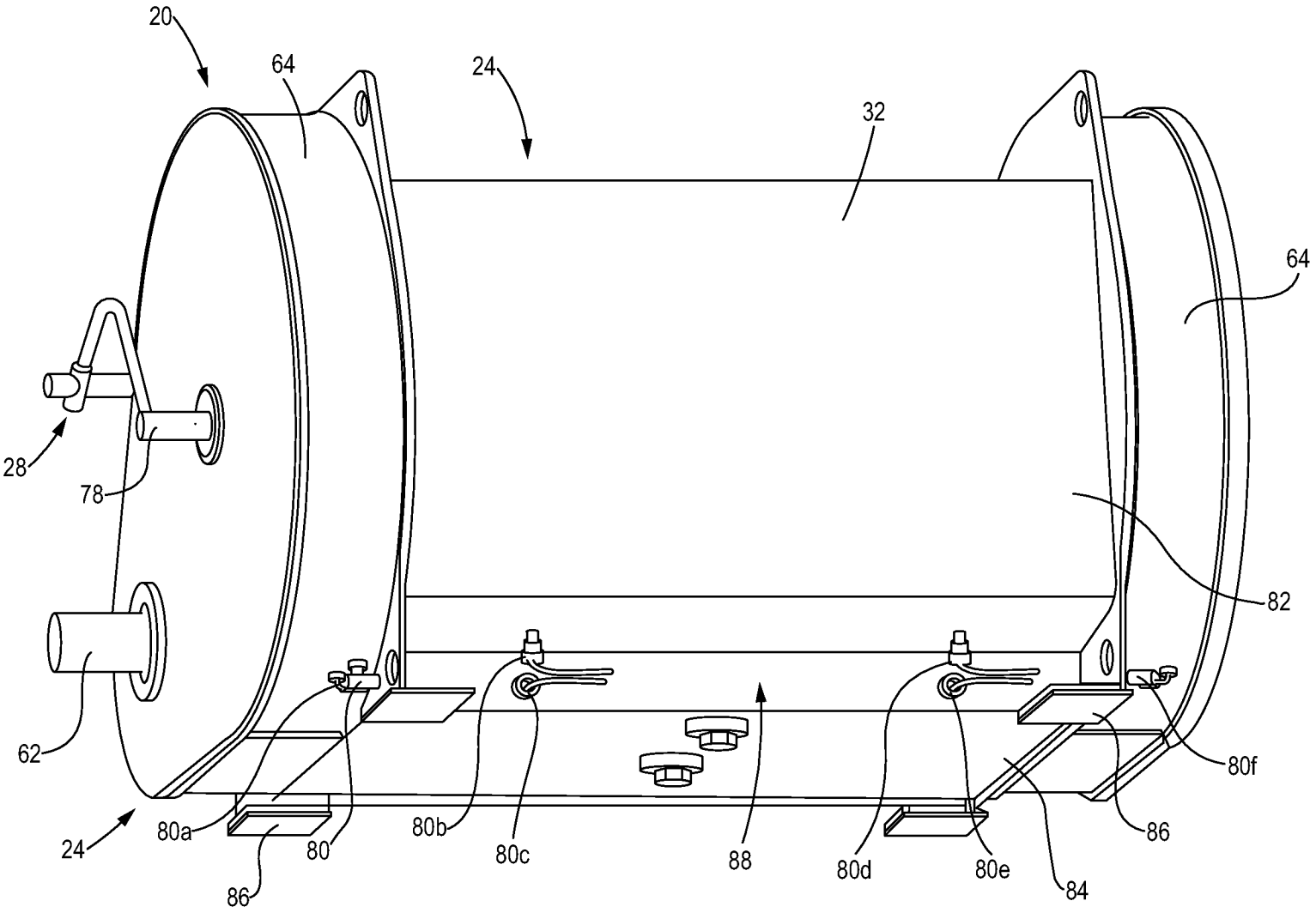
FIG. 4 is a bottom perspective view of a power end of a hydraulic pump, in accordance with an embodiment of the present disclosure.

Referring now to FIGS. 3 and 4, a plurality of vibration sensors 80 may be fixed to the pump housing 32 proximate the plurality of roller bearings 58. The pump housing 32 may include a rear surface 82 on a rear side of the pump 20 opposite the fluid end 26 of the pump. The pump housing 32 may also include a bottom surface 84 that includes a plurality of mounting brackets 86 for mounting the pump 20 to the trailer 18 or other surface. A portion of the pump housing 32 proximate a meeting area of the rear surface 82 and the bottom surface 84 may form a recess 88. The plurality of vibration sensors 80 may be installed in or proximate the recess 88. In the embodiment illustrated in FIGS. 3 and 4, six vibration sensors 80*a-f* are shown. A portion of the vibration sensors 80*b-e* may be positioned in the recess 88, while the remaining vibration sensors 80*a* and 80*f* may be affixed to the pump housing 32 or a gear cover 64. In an alternative arrangement, the number and arrangement of vibration sensors 80 may correspond directly to the number and arrangement of roller bearings 58. For example, the vibration sensors 80*a-f* be arranged linearly, along the rear surface 82 of the pump housing 32 or in the recess 88, such that each vibration sensor is directly proximate one of the roller bearings 58. The gear covers 64 are defined by the portions of the pump housing 32 that surround the gearbox outputs 52 and the gearbox inputs 54, among other components.

The vibration sensors 80 may be configured to monitor the vibrations generated by the roller bearings 58. For example, each vibration sensor 80 may measure an acceleration of each of the six roller bearings 58 over time. If, for example, during the monitoring, a shock pulse is measured at one or more of the roller bearings 58 at specific time intervals, then it may be determined that a defect exists in the roller bearing that generated the shock pulse. Each vibration sensor 80*a-f* may be any type of sensor configured to monitor the roller bearings 58, such as, but not limited to proximity switches, accelerometers or any other appropriate sensor. The vibration data measured by each vibration sensor 80 may be transmitted to the ECM 70 for analysis, as will be described in greater detail below.

Referring now to FIG. 5, at least one lubrication fluid quality sensor 66 may installed proximate the lubricant filter 60 to determine a quantity of particles present in the lubrication fluid. Preferably, the lubrication fluid quality sensor 66 may be fixed downstream from the lubricant filter 60 to ensure an accurate particle count. The lubrication fluid quality sensor 66 may include any type of device or any type of component that may count a quantity of particles and identify a size of the particles in the lubrication fluid at any given time. The lubrication fluid quality sensor 66 may measure a quantity of particles in a portion of the flow of the lubrication fluid flowing through the inlet valve 74, identify a size of the particles, and transmit information regarding the particles (e.g., the quantity of the particles and/or the size of the particles) to the ECM 70. The ECM 70 may then determine a quality of the lubricant fluid. The lubrication fluid quality sensor 66 may be an optical particle counter that may include a light source, that emits lights through the fluid, and may further detect particles based on obstruction of the light beam. Other types of particle sensor technology may also be used, including technology that counts metallic particles present in fluid by measuring a disturbance in a magnetic field.

The power end 24 of the pump 20 may further include a plurality of temperature sensors. While a pair of temperature sensors 68 are illustrated in FIG. 5, a single temperature sensor or multiple temperature sensors may be utilized. In the illustrated embodiment, an inlet temperature sensor 68*a* may be positioned proximate the inlet valve 74, and an outlet, temperature sensor 68*b* may be positioned proximate the outlet valve 76. The temperature sensors 68 may include any type of device(s) or any type of component(s) that may sense (or detect) a temperature of the lubrication fluid. The temperature sensors 68 may determine or obtain a temperature of the lubrication fluid, and may transmit the temperature information to the ECM 70. The ECM 70 may then determine whether a temperature difference between the lubrication fluid at the inlet valve 74 and the lubrication fluid at the outlet valve 76 exceeds a predetermined threshold value. The temperature sensors 68 may be a thermistor. Preferably, each of the temperature sensors 68 may directly contact the flow of the lubrication fluid. However, it will be appreciated that, in an alternate embodiment, the temperature of the lubrication fluid may be measured without direct contact between temperature sensors 68 and the lubrication fluid.

INDUSTRIAL APPLICABILITY

In operation, the present disclosure finds utility in various industrial applications, such as, but not limited to, in transportation, mining, construction, industrial, earthmoving, agricultural, and forestry machines and equipment. For example, the present disclosure may be applied to (racking machines, hauling machines, dump trucks, mining vehicles, on-highway vehicles, off-highway vehicles, trains, earthmoving vehicles, agricultural equipment, material handling equipment, and/or the like. More particularly, the present disclosure relates to monitoring the health of the power end 24 of the hydraulic pump 20 to prevent failure of the hydraulic pump 20 and its components.

Figure 6:
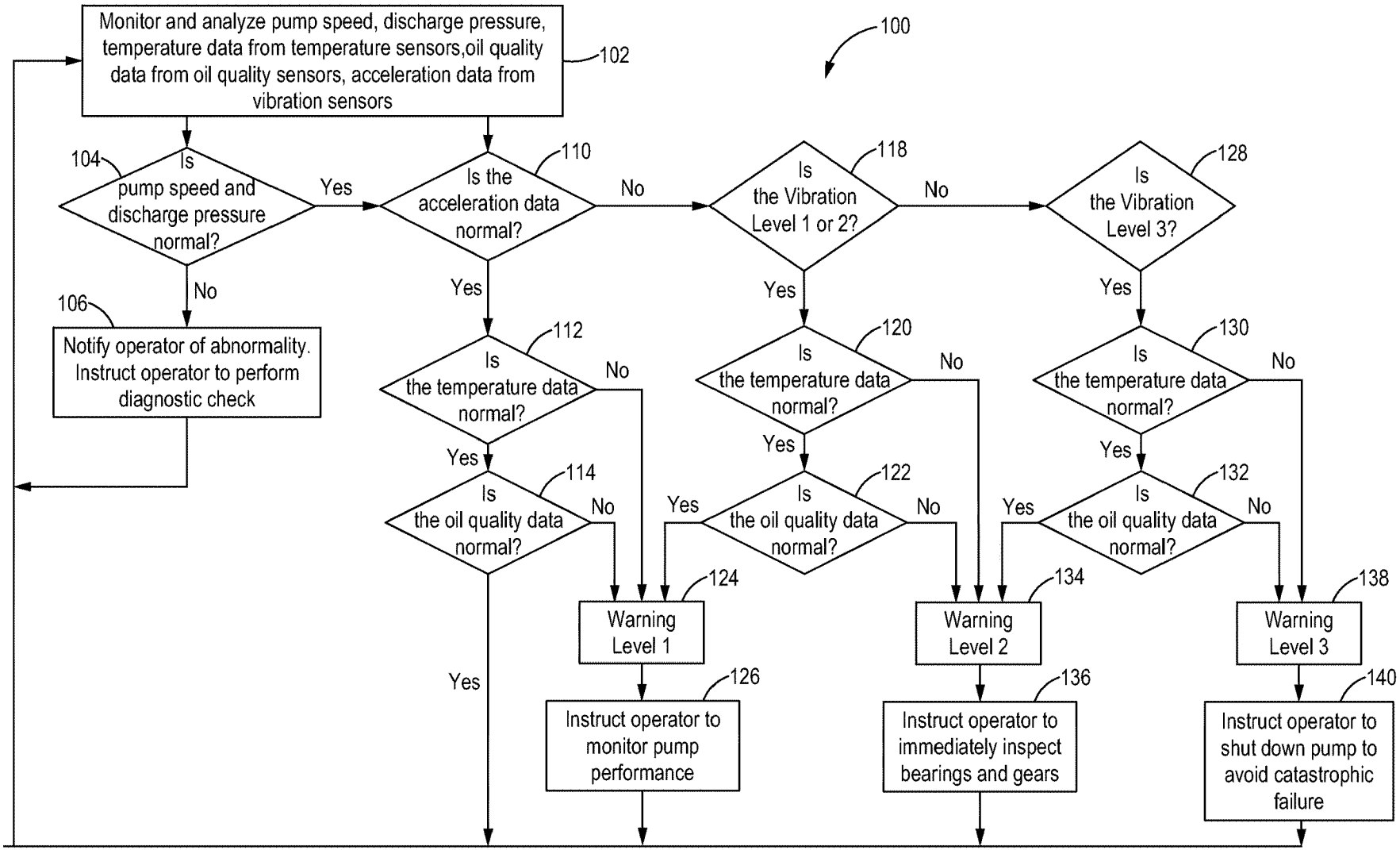
FIG. 6 is a flowchart illustrating a method of detecting and signaling failure of a hydraulic pump, in accordance with an embodiment of the present disclosure.

A series of steps 100 involved in monitoring the health of the power end 24 of the hydraulic pump 20 is illustrated in a flowchart format in FIG. 6. The series of steps 100 may be performed by the ECM 70. As shown in FIG. 6, in a first step 102, a speed of the pump 20, a discharge pressure of the fracking fluid, data from each temperature sensor 68, data from each lubrication fluid quality sensor 66, and data from each vibration sensor 80 may be received and analyzed by the ECM 70. Monitoring and transmitting the discharge pressure of the fracking fluid may be accomplished through any means known in the art, including, for example, through the use of one or more pressure sensors 47 (see FIG. 2). Similarly, monitoring and transmitting the speed of the pump 20 may be accomplished by operatively coupling the crankshaft 56 to the ECM 70 or other computer-implemented system, although other methods and systems known in the art may be utilized as well.

The data received by the ECM 70 during the monitoring and analyzing step 102 includes data gathered by the lubrication fluid quality sensor 66. More specifically, the lubrication fluid quality sensor 66 may determine the presence of particles, may subsequently measure a quantity of particles in the flow of the lubrication fluid, may determine a size of each of the particles in the flow of the lubrication fluid, and may transmit this data (collectively referred to hereinafter as "lubrication fluid quality data") to the ECM 70. The lubrication fluid quality sensor 66 may detect the presence of particles, measure the quantity of particles and/or determine a size of the particles independently of the ECM 70, and subsequently transmit, to the ECM 70, the quantity of the particles, the size of each of the particles, and/or the like. In other implementations, the ECM 70 may cause the lubrication fluid quality sensor 66 to count the quantity of particles and/or determine a size of the particles.

The ECM 70 may then analyze the lubrication fluid quality data, and determine a quality of the lubrication fluid. More specifically, the lubrication fluid quality data may be compared to a predetermined threshold of acceptable quantity and size of particles, as well as to a predetermined threshold slope or rate of increase. The predetermined threshold may be stored in the memory associated with the ECM. If the lubrication fluid quality data indicates a particle count or size above the predetermined threshold and/or an increase in quantity of particles over a short period of time, then the pump 20 may be operating under a possibility of impeding failure. Consequently, a lubrication fluid quality warning may be triggered.

Additional data received by the ECM 70 during the monitoring and analyzing step 102 includes data gathered by the lubrication fluid temperature sensors 68. More specifically, the inlet valve sensor 68*a* may measure a temperature of the lubrication fluid flowing through the inlet valve 74, and the outlet valve sensor 68*b* may measure a temperature of the lubrication fluid flowing through the outlet valve 76. The lubrication fluid temperature sensors 68 may transmit this data (collectively referred to hereinafter as "lubrication fluid temperature data") to the ECM 70.

The ECM 70 may then analyze the lubrication fluid temperature data by first calculating a difference between the lubrication fluid temperature at the inlet valve 74 and the outlet valve 76. The calculated difference may then be compared to a predetermined threshold of allowable temperature difference that may be stored in the memory associated with the ECM. Generally, if the lubrication fluid temperature data indicates a temperature difference in the lubrication fluid greater than 50° C., then the pump 20 may be operating under a possibility of impeding failure. However, the predetermined threshold may vary according to site parameters, the type of lubrication fluid used, operating conditions, and other variables. In other embodiments, for example, the predetermined threshold may be as low as 1° C. or as high as 100° C. Regardless, if the lubrication fluid temperature data indicates a temperature difference in the lubrication fluid greater than the predetermined threshold of allowable temperature difference, then a lubrication fluid temperature warning may be triggered.

Further data received by the ECM 70 during the monitoring and analyzing step 102 includes data gathered by the plurality of vibration sensors 80. More specifically, the vibration sensors 80 may determine a vibration, or acceleration of the roller bearings 58, and may transmit this data (collectively referred to hereinafter as "acceleration data") to the ECM 70. The vibration sensors may measure the acceleration or vibrations of the roller bearings 58 independently of the ECM 70, and subsequently transmit, to the ECM 70, the acceleration data, and/or the like, in other implementations, the ECM 70 may cause the vibration sensors 80 to determine the acceleration directly.

The ECM 70 may analyze the acceleration data along with the speed of the pump 20 (hereinafter, "pump speed") and the discharge pressure of the fracking fluid in order to determine a vibration level. However, in order to accurately determine a vibration level, the pump speed and discharge pressure must be analyzed to ensure their values indicate normal operation. For example, if the pump speed and discharge pressure values are abnormal, then the calculation of vibration level could be inaccurate. As such, if either the pump speed or discharge pressure is abnormal (step 104), the operator of the fracking machine 10 is notified and instructed to perform a diagnostic to determine the cause of the abnormal data readings (step 106). Once the pump speed and discharge pressure are determined to be in a normal range, the pump speed, fracking fluid discharge pressure and acceleration data are compared together with various failure models. The failure models may be stored in the memory associated with the ECM 70. The ECM 70 may perform vibration based detection calculations on the acceleration data. For example, the ECM 70 may perform root mean square (RMS) calculations, skewness calculations, or any other vibration signal based analysis at a fault frequency of the roller bearings 58 with filter or envelope technology applied. With the vibration based calculations performed, the ECM 70 may be configured to analyze the calculations with the pump speed and discharge pressure in order to determine a vibration level. If, for example, based on the vibration based detection calculations, it is determined that the pump 20 is operating normally, without a possibility of impending failure, a vibration level of "Normal" may be assigned. If, for example, based on the RMS calculations, it is determined that the pump 20 is operating abnormally, with a possibility of impending failure, a vibration level of 1, 2 or 3 may be assigned based on the severity of the vibrations.

Once the vibration data, the lubrication fluid quality data and the lubrication fluid temperature data have each been analyzed, the ECM 70 then determines an overall pump failure warning level based on the analyzed data. At a decision block 110, the ECM 70 may examine whether, during analysis of the vibration data (block 102), the vibration level was determined to be "Normal." If the vibration level was determined to be within the normal range, then at the next decision blocks 112 and 114, the ECM 70 examines whether the lubrication fluid temperature warning or the lubrication fluid quality warning was triggered during analysis. If neither the lubrication fluid temperature warning nor the lubrication fluid quality warning were triggered, then the pump 20 is determined to be operating normally, and the ECM will continue to monitor analyze the data related to the health of the fracking machine 10 (block 102). In other embodiments, when the vibration level, oil quality and temperature are all considered to be "normal" (i.e., no vibration level set, and no oil quality or temperature warnings triggered), the ECM 70 may transmit, to a display of an operator of the fracking machine 10, a "No Warning" status, along with an instruction to take no abnormal actions in operating the fracking machine. After displaying the status to the operator, the ECM 70 may then return to monitoring and analyzing the data related to the health of the fracking machine 10 (block 102).

If, however, at decision blocks 112 and 114, the ECM 70 determines that at least one of the lubrication fluid temperature warning or the lubrication fluid quality warning was triggered during analysis, then a failure "Warning Level 1" (block 124) status may be set by the ECM. The ECM 70 may then transmit, to the operator display (not shown), the failure "Warning Level 1" status, along with an instruction to the operator of the fracking machine 10 to closely monitor pump performance statistics including pump speed, discharge pressure, and other data (block 126). After transmitting the instructions to the operator display, the ECM 70 may return to monitoring and analyzing the data related to the health of the fracking machine 10 (block 102).

At a decision block 118, the ECM 70 may examine whether, during analysis of the vibration data (block 102), the vibration warning "Level 1" or "Level 2" were triggered. If either of these warning levels were triggered, then at the next decision blocks 120 and 122, the ECM 70 examines whether the lubrication fluid temperature warning or the lubrication fluid quality warning was also triggered during analysis. If neither the lubrication fluid temperature warning nor the lubrication fluid quality warning were triggered (i.e., the fluid temperature and lubrication fluid quality were determined to be "normal"), then the pump 20 is determined to be operating at a failure "Warning Level 1" status (block 124). The ECM 70 may then transmit the failure "Warning Level 1" status to the operator display along with an instruction to the operator to closely monitor pump 20 performance include g pump speed, discharge pressure, and other data (block 126).

If, however, at decision blocks 120 and 122, the ECM 70 determines that at least one of the lubrication fluid temperature warning or the lubrication fluid quality warning was triggered during analysis, then a failure "Warning Level 2" (block 134) status is set by the ECM. The ECM 70 may then transmit the "Warning Level 2" status to the operator display, along with an instruction to the operator of the fracking machine 10 to immediately inspect the roller bearings 58 and the gearboxes 52, 54 (block 136). After transmitting these instructions to the operator display, the ECM 70 may return to monitoring and analyzing the data related to the health of the fracking machine 10 (block 102).

Finally, at a decision block 128, the ECM 70 examines whether, during analysis of the vibration data, the vibration warning "Level 3" was triggered. If this warning level was triggered, then at the next decision blocks 130 and 132, the ECM 70 examines whether the lubrication fluid temperature warning or the lubrication fluid quality warning was also triggered during analysis. If neither the lubrication fluid temperature warning nor the lubrication fluid quality warning were triggered, then the pump 20 is determined to be operating at a failure "Warning Level 2" status (block 134). The ECM 70 may then transmit the failure "Warning Level 2" status to the operator display along with an instruction to the operator of the fracking machine 10 to immediately inspect the roller bearings 58 and the gearboxes 52, 54 (block 136). After transmitting these instructions, the ECM 70 may return to monitoring and analyzing the data related to the health of the fracking machine 10 (block 102).

If, however, at decision blocks 130 and 132, the ECM 70 determines that at least one of the lubrication fluid temperature warning or the lubrication fluid quality warning was triggered during analysis, then a failure "Warning Level 3" (block 138) status is set by the ECM. The ECM 70 then transmits, the failure "Warning Level 3" status to the operator display, along with an instruction to the operator of the fracking machine 10 to immediately shut down the pump 20, as catastrophic failure is imminent (block 140). After transmitting these instructions to the operator display, the ECM 70 may return to monitoring and analyzing the data related to the health of the fracking machine 10 (block 102).

While a series of steps and operations have been described herein, those skilled in the art will recognize that these steps and operations may be re-arranged, replaced, or eliminated, without departing from the spirit and scope of the present disclosure as set forth in the claims.

With implementation of the present disclosure, operators of pumps may be alerted of a possible failure of a component in the pump before a catastrophic failure occurs. With early indication of a possible failure, operators of a given pump may conveniently plan to perform shutdown, replacement, maintenance, overhaul, and/or other service routines on the pump in a timely manner with little or no obstruction to an ongoing procedure in a jobsite (i.e., a wellbore). Moreover, upon detection of a possible failure, operators may conveniently perform the necessary actions, as the present disclosure is configured to additionally provide a manner of taking corrective actions to prevent failure. Furthermore, with implementation of the present disclosure, time and effort previously incurred with maintenance of pumps may be offset, saving costs to operators of pumps.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A hydraulic fracturing machine with a pump failure detection system, the hydraulic fracturing machine comprising:

a hydraulic fracturing pump having a power end and a fluid end, the power end including a plurality of roller bearings, the fluid end having a flow of fluid, wherein the power end includes an inlet valve for receiving fluid in the power end of the pump and an outlet valve for discharge of the fluid from the power end of the pump;

two temperature sensors, wherein a first temperature sensor is positioned at the inlet valve and a second temperature sensor is positioned at the outlet valve, the first and second temperature sensors directly contacting a flow of fluid in the power end and configured to transmit temperature information regarding the flow of fluid in the power end;

a particle sensor coupled to the power end and configured to transmit particle information regarding a quantity of particles in the flow of fluid in the power end;

a vibration sensor coupled to the power end and configured to transmit vibration information regarding a vibration of each of the plurality of roller bearings; and an electronic control module configured to analyze the particle information, the temperature information and the vibration information, and to calculate a failure warning level based on the analysis.

2. The hydraulic fracturing machine of claim 1, wherein the electronic control module is further configured to receive the particle information, the temperature information and the vibration information transmitted by the particle sensor, the temperature sensor and the vibration sensor.

3. The hydraulic fracturing machine of claim 1, wherein the electronic control module is further configured to provide the calculated failure warning level to an operator of the hydraulic fracturing machine.

4. The hydraulic fracturing machine of claim 1, wherein the vibration sensor is coupled to a housing of the power end of the hydraulic pump proximate the plurality of roller bearings.

5. The hydraulic fracturing machine of claim 1, further including a plurality of vibration sensors positioned proximate the plurality of roller bearings.

6. The hydraulic fracturing machine of claim 5, wherein at least one of the plurality of vibration sensors is coupled to a housing of the power end of the hydraulic pump, and at least one of the plurality of vibration sensors are coupled to a gear cover of the power end of the hydraulic pump.

7. The hydraulic fracturing machine of claim 1, wherein the particle sensor is positioned downstream from a fluid filter.

8. A failure detection system for a hydraulic pump including a lubrication system, the failure detection system comprising:

a particle sensor operatively disposed in the lubrication system, the particle sensor configured to monitor and transmit particle data including a quantity of particles in a lubricant flowing through the lubrication system;

an inlet temperature sensor operatively disposed in an inlet valve of the lubrication system and an outlet temperature sensor operatively disposed in an outlet valve of the lubrication system, each of the inlet temperature sensor and the outlet temperature sensor configured to monitor and transmit temperature data including a temperature of the lubricant;

a plurality of vibration sensors coupled to a power end of the hydraulic pump, the plurality of vibration sensors configured to monitor and transmit vibration data including an acceleration of each of a plurality of roller bearings; and an electronic control module in operative communication with the particle sensor, the temperature sensor, and the plurality of vibration sensors, the electronic control module coupled to the power end of the hydraulic pump and configured to:

receive the particle data transmitted by the particle sensor;

determine a quantity of particles in the lubricant based on the received particle data;

trigger a quality warning if the quantity of particles exceeds a predetermined threshold particle value;

receive the temperature data transmitted by the inlet temperature sensor and the outlet temperature sensor;

calculate a difference value between the temperature data received from the inlet temperature sensor and the temperature data received from the outlet temperature sensor;

trigger a temperature warning if the difference value exceeds a predetermined threshold temperature value;

receive vibration data transmitted by the plurality of vibration sensors;

trigger a vibration warning if, after performing vibration based detection calculations on the vibration data, a threshold vibration value is exceeded;

calculate a failure warning level of the hydraulic pump based on the quality warning, the temperature warning and the vibration warning; and transmit the failure warning level to an operator of the hydraulic pump.

9. The failure detection system of claim 8, wherein the threshold vibration value is determined by the electronic control module based on a current pump speed of the hydraulic pump and a discharge pressure of a fluid flowing through the hydraulic pump.

10. The failure detection system of claim 8, wherein the lubrication system includes a lubricant filter, the particle sensor being positioned downstream from the lubricant filter.

11. The failure detection system of claim 8, wherein the plurality of vibration sensors are coupled to a housing of the power end of the hydraulic pump proximate the plurality of roller bearings.

12. The failure detection system of claim 8, wherein the calculated warning level is transmitted to the operator via an electronic display.

13. The failure detection system of claim 12, wherein the operator of the hydraulic pump is instructed, via the electronic display, to take actions specific to the calculated failure warning level.

* * * * *